United States Patent [19]

Davis

[11] Patent Number: 4,494,911

[45] Date of Patent: Jan. 22, 1985

[54] PISTON PUMP SERVO CONTROL

[75] Inventor: Duane J. Davis, Galesburg, Mich.

[73] Assignee: General Signal Corporation, Stamford, Conn.

[21] Appl. No.: 489,772

[22] Filed: Apr. 29, 1983

[51] Int. Cl.[3] ..... F04B 1/26

[52] U.S. Cl. ..... 417/222; 60/390; 60/911

[58] Field of Search ..... 417/218, 222; 91/506; 60/388, 389, 390, 911

[56] References Cited

U.S. PATENT DOCUMENTS

| | | | |
|---|---|---|---|
| 3,432,791 | 3/1969 | Palmer | 200/61.89 |
| 3,488,954 | 1/1970 | Thomas et al. | 60/390 |
| 3,646,754 | 3/1972 | Koch et al. | 60/390 |
| 3,667,225 | 6/1972 | Karman | 60/390 |
| 3,738,110 | 6/1973 | Grosseau | 60/388 X |
| 3,788,775 | 1/1974 | Leutner et al. | 417/222 |
| 3,901,031 | 8/1975 | Knapp et al. | 60/444 X |
| 3,933,083 | 1/1976 | Weisenbach et al. | 92/12.2 |
| 4,091,617 | 5/1978 | Cornell | 60/911 X |
| 4,189,921 | 2/1980 | Knapp | 60/445 |
| 4,274,257 | 6/1981 | Koch, Jr. et al. | 417/222 X |
| 4,285,639 | 8/1981 | Woodring et al. | 417/218 |
| 4,351,152 | 9/1982 | Reynolds et al. | 60/911 X |
| 4,370,856 | 2/1983 | Ito et al. | 60/389 |
| 4,395,199 | 7/1983 | Izumi et al. | 417/34 X |
| 4,456,434 | 6/1984 | El Ibiary | 417/218 |

FOREIGN PATENT DOCUMENTS 2449412 4/1975 Fed. Rep. of Germany ..... 417/222

*Primary Examiner*—William L. Freeh
*Assistant Examiner*—Paul F. Neils
*Attorney, Agent, or Firm*—Barnes & Thornburg

[57] ABSTRACT

An electronic closed loop piston pump servo control system including a swash plate within the pump housing which controls pump output as a function of its position about a rotational axis, means for altering the position of said swash plate, means for producing electric signals representative of the desired and actual swash plate angular positions, and means for comparing these signals and producing a control or error signal to the means for altering the swash plate position as a function of these signal differences. The means for producing electric signals representative of the actual swash plate position includes a rotary potentiometer mounted in the pump housing and directly connected to the swash plate along a common axis of rotation. This potentiometer produces a d.c. signal indicating the angular position of the swash plate on this common axis. A failsafe circuit is provided in the comparator means which prevents the error signal from affecting the swash plate angular position if the feedback signal falls below a predetermined reference level. The potentiometer rotates through a relatively small arc such that when the sliding resistive contacts thereon are worn, the potentiometer contacts may be rotated to respond along a fresh arc.

9 Claims, 3 Drawing Figures

PISTON PUMP SERVO CONTROL

BACKGROUND OF THE INVENTION

The present invention relates generally to pump control systems and, more particularly, to closed loop pump output control systems for variable displacement piston pumps.

Variable displacement piston pumps typically have swash plates or trunions within their housings which may be adjusted so as to control the pump output for a given pump speed. These swash plates are often rotatable about an axis, and the position of the swash plate is proportional to the pump output level. To provide precise control of the pump outputs, prior art devices have used the swash plates to create feedback signals which may be compared to signals representing the desired pump output. A qualitative difference or "error" between these signals may be used to create a control signal to various means for adjusting the swash plate position and, thus, the pump output.

Previous control systems have used hydraulic as well as electrical signals and signal comparison means. Hydraulic circuits for this purpose typically include complicated differential pressure comparators and suffer from leakage problems as well as excessive weight. In addition, complex hydraulic circuits are expensive to fabricate and take up considerably more space than corresponding electrical circuits. Electrical circuits for this purpose usually have a much faster response time and greater signal stability. Prior electrical circuits typically create swash plate position feedback signals by means of linear variable differential transformers (LVDTs) attached to the swash plate controlling piston or by means of rotary potentiometers attached to the swash plate exteriorly of the pump housing by means of mechanical linkages. LVDTs are usually spring biased variable inductors and require an a.c. control system. While potentiometers permit a d.c. control system, their connecting mechanical linkages are complicated and often wear down and result in slack which decreases system response time. Since the potentiometers are remote from the movement of the actual swash plate, there are also inherent loses in accuracy. Further, rotatable potentiometers will often wear out faster than LVDTs, since they have sliding contact surfaces.

Accordingly, the need has arisen to provide a simplified electronic control system for variable displacement pumps having increased precision and stability as well as an extended useful life.

SUMMARY OF THE INVENTION

An object of the present invention is the provision of a control system for pumps wherein the swash plate position is detected to determine pump output at a given pumping rate.

Another object of the present invention is to provide a simplified electronic control system to control pump output and having a reduced response time and an increased useful lifetime.

A further object of the present invention is the provision of a slack-free direct mounting of an electric angular position indicating means on a piston pump swash plate.

A still further object is to provide a stable and precise d.c. control system for variable displacement pumps requiring low voltage and low current input.

These and other objects of the present invention are attained in the provision of an electronic closed loop piston pump control system including a swash plate within the pump housing and controlling pump output as a function of its position about a rotational axis, means for altering the position of said swash plate, means for producing electric signals representative of the desired and actual swash plate angular position, and means for comparing these signals and producing a control or error signal to the means for altering the swash plate signal position as a function of their differences. The means for producing electric signals representative of the actual swash plate position includes a rotary potentiometer mounted in the pump housing and directly connected to the swash plate along a common axis of rotation. This potentiometer produces a d.c. signal indicating the angular position of the swash plate on this common axis. A failsafe circuit is provided in the comparator means which prevents the error signal from effecting an alternation in the swash plate position if the feedback signal falls below a predetermined reference level. The potentiometer rotates through a relatively small arc such that when the sliding resistive contacts thereon are worn, the potentiometer contacts may be rotated to respond along a fresh arc.

Other objects, advantages, and novel features of the present invention will become readily apparent when the following detailed description of the preferred embodiment is considered in conjunction with the attached drawings.

DESCRIPTION OF THE PREFERRED EMBODIMENT

Figure 1:
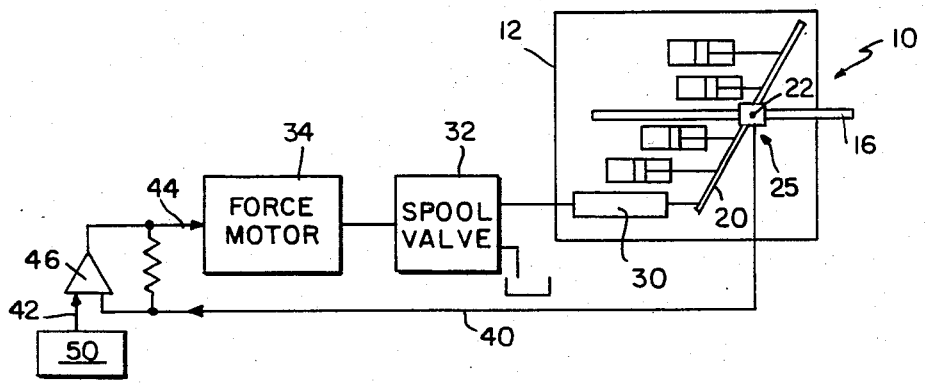
FIG. 1 shows a schematic block diagram of a pump control system according to a preferred embodiment of the present invention.

FIG. 1, which illustrates a schematic block diagram of a closed loop pump servo control system according to the present invention, shows a variable displacement piston pump 10 having swash plate 20 within housing 12 thereof. The angular position of swash plate 20 about axis of rotation 22, shown in FIG. 1 as a pivot point extending normally out of the plane of the drawing, may be altered by trunion control 30 in response to spool valve 32. Spool valve 32 is in turn actuated by force motor 34 in response to electric control signals applied thereto. Spool valves and force motors per se are known in the art (see, for example, U.S. Pat. No. 4,351,152).

Rotary potentiometer 25 is provided within pump housing 12 and directly connected to swash plate 20, axis of rotation 25 being common to both potentiometer 25 and swash plate 20. Potentiometer 25 provides a d.c. electric signal indicative of its angular position to line 40. Input control means 50 provides a d.c. electric signal indicative of the desired angular location of swash plate 20 to line 42. Comparator means 46 receives these potentiometer and control input means signals as input signals from lines 40 and 42 and produces output signals alone line 44 as electric control signals for force motor 34.

As is well known in the prior art, swash plate 20 controls the volume which may be pumped by variable displacement pump 10 at a given rate of pumping. As swash plate 20 rotates about axis 22, the output of pump 10 changes. Thus, the angular position of swash plate 20 and the angular position of potentiometer 25, since they are mounted coaxially, are representative of the output of pump 10. As potentiometer 25 produces a d.c. electric signal proportional to its angular position, the input signals along line 40 to comparator means 46 are, thus, also proportional to pump output. Input control means 50 provides input signals along line 42 to comparator means 46 which are representative of the pump output level desired by providing electric signals representative of the corresponding desired swash plate angular position.

When force motor 34 receives control signals from line 44, it causes trunion control 30 to adjust the angular position of swash plate 20 so as to minimize the error signal from comparator means 46. When the error signal is zero, no further adjustment of swash plate 20 is made.

Figure 2:
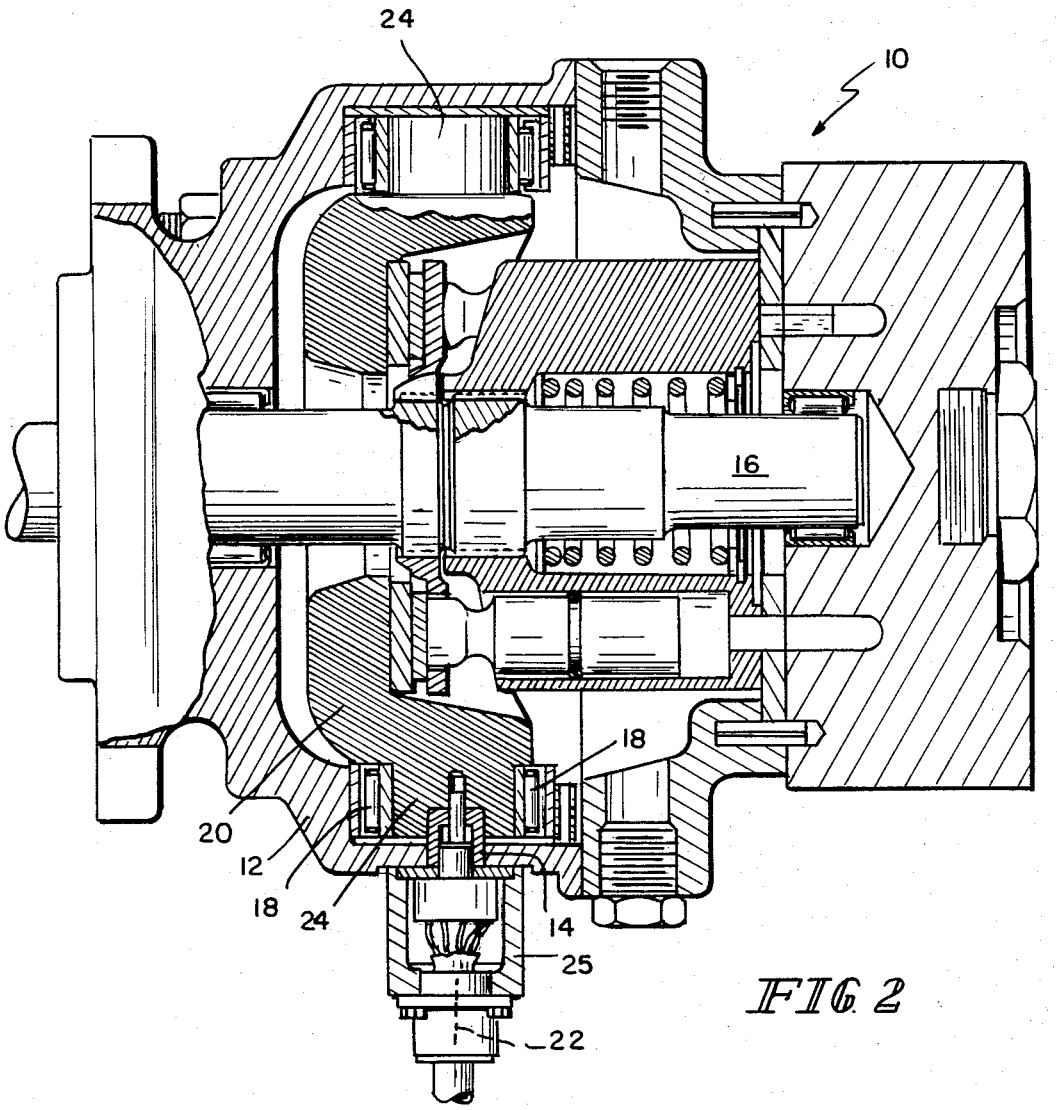
FIG. 2 shows a cross section of a variable displacement pump incorporating the rotary potentiometer of the present invention.

As shown in FIG. 2, potentiometer 25 is mounted directly on housing 12 of pump 10 and about rotational axis 22. Swash plate 20 has axial flanges 24 supported on bearings 18 within housing 12 and which permit swash plate 20 to pivot about axis 22 within stationary housing 12. A portion 27 of potentiometer 25 having sliding electrical contacts passes through aperture 14 in housing 12 and is fixed within bore 26 of one of rotatable axial flange 24. The remainder of potentiometer 25 is fixed to stationary housing 14. As drive shaft 16 rotates within pump 10, the angular position of swash plate 20 with respect to axis 22 remains constant unless altered by trunion control 30. This direct mounting arrangement eliminates the need for external mechanical linkages and the inherent coupling slack and inertia of such linkages. Thus, in simplifying the construction, the present invention also increases the precision and stability of the feedback signals.

By using a rotating potentiometer, the feedback signal producing means itself is simplified. While prior art LVDTs are spring biased and often need 110 volts a.c. control circuit voltage, rotary potentiometers enable control circuit voltage to be less than 15 volts d.c. Although the present invention discloses the use of a rotary potentiometer having sliding resistive contacts as its preferred embodiment, it is specifically contemplated that other angular transducers may also be employed. Again, since such transducers are mounted directly to the pivotal axis of the swash plate, no spring biasing is necessary and precise angular positions may be determined.

Further, a rotary potentiometer may be employed so as to have an extended useful lifetime for producing feedback signals. Since it is mounted directly to pivotal axis 22, the operating rotational arc of potentiometer 25 may be typically less than 20°. When the sliding resistive contacts within this arc are worn, potentiometer contacts may be rotated so that fresh contacts are within this operating rotational arc.

Figure 3:
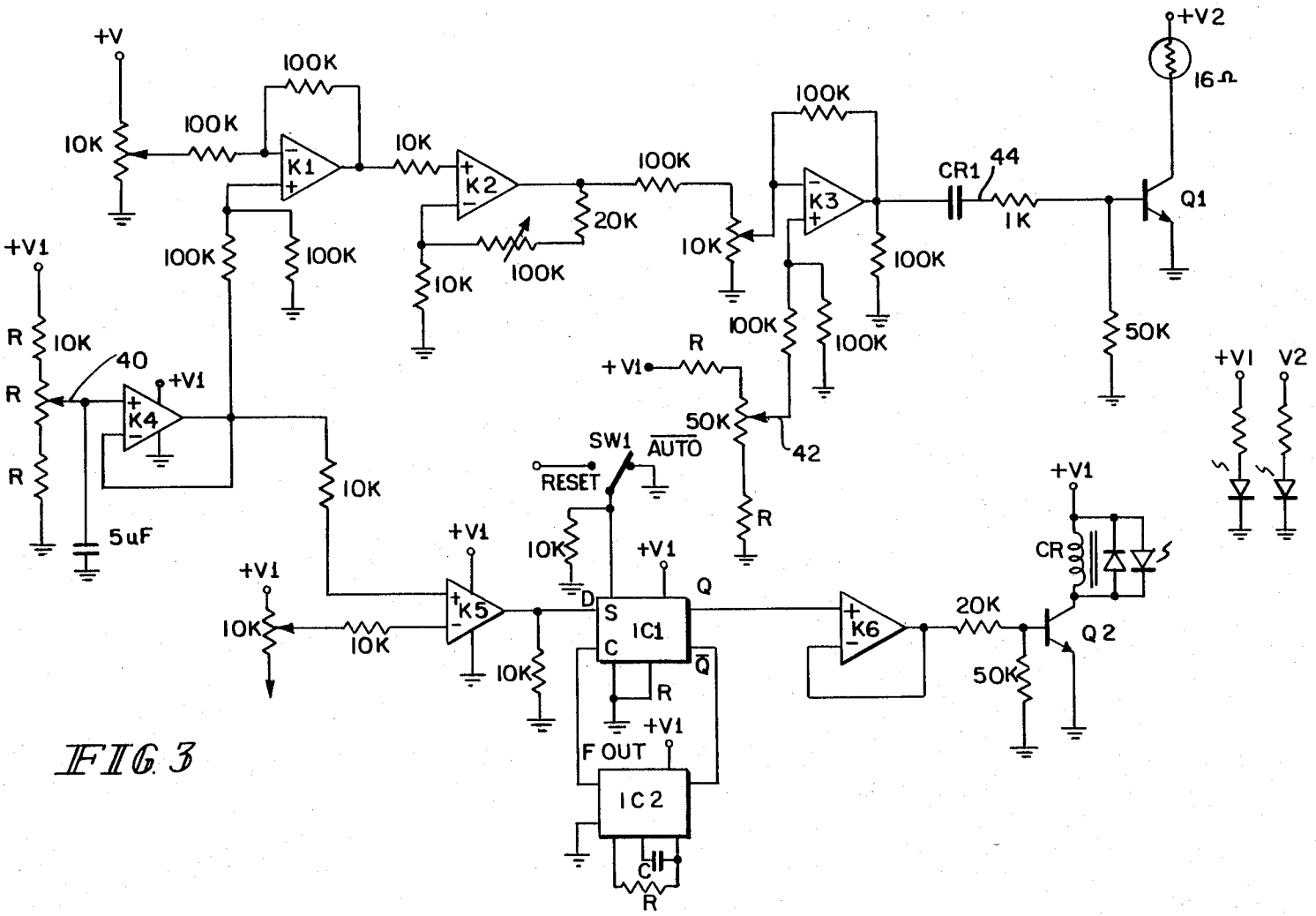
FIG. 3 shows a schematic diagram of a comparator circuit suitable for use in the present invention.

FIG. 3 shows a schematic diagram of a six amplifier circuit suitable for comparator means 46. Feedback signals from potentiometer 25 along line 40 may have a range of ±600 mv and are input to amplifier means K4. The voltage out of K4 includes a d.c. reference voltage of, for example, 9 volts. The output of K4 is input to amplifier means K1 which subtracts the 9 volt reference voltage and passes the feedback signals to non-inverting amplifier means K2. K2 amplifies the 0–600 mv feedback signal to the 0–12 volt range. The gain of K2 controls the sensitivity of comparator means 46 to changes in the feedback signals from potentiometer 25. The output of K2 and the signals from input control means 50 are input to amplifier means K3 which determines the difference between these input signals and produces error signals along line 44 to serve as control signals for force motor 34.

Amplifier K5 also receives the output from K4 and compares that signal with a predetermined fail-safe reference signal. The output of K5 is an input to "D" type flip-flop IC 1. This flip-flop may, for example require a square wave signal input to clock the data signal from K5 through to buffer K6. Such a square wave signal at for example, a frequency of 10 Kilohertz may be provided by signal generator 1C 2. The output of K5 will be 12 volts if the output of K4 is greater than the fail-safe reference signal. The output of K5 will be 0 volts if the output of K4 is less than the fail-safe reference signal. If the output of K5 is 12 volts, this signal will be clocked through IC 1 to K6. The output of K6 will also be 12 volts. This 12 volt signal may be applied to the base of transistor Q2 to turn the transistor full on. With transistor Q2 full on, relay coil CR1 will be energized, closing relay contacts CR1 in line 44. If the output of K5 is 0 volts, this signal will be clocked through IC 1 to K6. An output of 0 volts applied to the base of transistor Q2 will turn the transistor full off. If the transistor is full off, relay coil CR1 is not energized and the relay contacts in line 44 are open. With the relay contacts open, the error signal from K3 cannot be applied to the base of transistor Q1. With the transistor Q1 turned off by the lack of error voltage being applied to the base, the coil of force motor 34 is not energized and the pump returns to the full off condition. When 0 voltage is clocked throgh IC 1, square wave signal generation is turned off and stays off until it is restarted by pushing RESET switch SW 1. If the output of K4 remains less than the fail-safe reference signal and switch SW 1 is returned to the AUTO position, the 0 voltage signal will be clocked through IC 1 and the pump will return to the full off position.

Although the present invention has been described and illustrated above in detail, the same is to be taken by way of illustration and example only and not to imply limitation. Those skilled in the art will recognize that many variations on this example are within the spirit of the subject invention. The spirit and scope of the subject invention are to be limited only by the terms of the appended claims.

What is claimed is:

1. A pump control system for controlling the pump output flow at a given pump speed comprising:

a variable displacement pump having a housing and a rotatably positionable swash plate therein for controlling the output of said variable displacement pump;

means for altering the position of said swash plate so as to change said pump output flow in response to control signals;

means for producing an electric signal representative of the desired swash plate position;

an electric feedback signal producing means mounted within said pump housing and directly connected to said swash plate for indicating the actual position of said swash plate; and means for comparing said electric signals representing the desired and actual swash plate positions and producing an error signal representative of the difference between these two positions, and means for providing control signals to said means for altering the position of said swash plate as a function of said difference so as to cause said error signal to be decreased by altering swash plate position, and said means for providing control signals also includes a failsafe means generating a reference signal, comparing said feedback signal to said reference signal, and preventing said means for providing control signals from altering the position of said swash plate when the magnitude of said reference signal is greater than said feedback signal.

2. The pump control system according to claim 1, wherein said electric signals representing the desired and actual swash plate position and the error signals are d.c. signals.

3. The pump control system according to claim 1, wherein said control system operates on fifteen volts maximum direct current.

4. The pump control system according to claim 1, wherein said means for altering the position of said swash plate includes a force motor means driving spool valve means.

5. The pump control system according to claim 1, wherein said electric feedback signal producing means includes a rotary potentiometer.

6. The pump control system according to claim 5, wherein said rotary potentiometer creates electrical signals representative of the actual angular position of said swash plate about the axis of rotation of said swash plate.

7. The pump control system according to claim 6, wherein said rotary potentiometer is disposed such that its rotational axis is along said rotational axis of said swash plate.

8. The pump control system according to claim 6, wherein said swash plate includes axial flanges supported within said pump housing and which permit said swash plate to pivot about said axis of rotation, and wherein a portion of said rotary potentiometer is fixedly disposed in a bore in one of said axial flanges.

9. The pump control system according to claim 8, wherein said rotary potentiometer rotates through an arc of less than 20° in response to maximum rotation of said swash plate.

* * * * *